US007413010B2

(12) United States Patent
Blauch et al.

(10) Patent No.: US 7,413,010 B2
(45) **Date of Patent: *Aug. 19, 2008**

(54) REMEDIATION OF SUBTERRANEAN FORMATIONS USING VIBRATIONAL WAVES AND CONSOLIDATING AGENTS

(75) Inventors: Matthew E. Blauch, Duncan, OK (US); Thomas D. Welton, Duncan, OK (US); Philip D. Nguyen, Duncan, OK (US); James J. Venditto, Richmond, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 283 days.

This patent is subject to a terminal disclaimer.

(21) Appl. No.: 11/355,042

(22) Filed: Feb. 15, 2006

(65) Prior Publication Data

US 2006/0131012 A1 Jun. 22, 2006

Related U.S. Application Data

(63) Continuation-in-part of application No. 10/863,706, filed on Jun. 8, 2004, now Pat. No. 7,114,560, which is a continuation-in-part of application No. 10/601,407, filed on Jun. 23, 2003, now Pat. No. 7,025,134.

(51) Int. Cl.
*E21B 28/00* (2006.01)
*E21B 43/04* (2006.01)
*E21B 43/267* (2006.01)

(52) U.S. Cl. ..... 166/249; 166/276; 166/281; 166/295

(58) Field of Classification Search ..... 166/90.1, 166/177.1, 177.2, 177.6, 249, 276, 281, 295, 166/300

See application file for complete search history.

(56) References Cited

U.S. PATENT DOCUMENTS

| | | | | |
|---|---|---|---|---|
| 2,238,671 | A | 4/1941 | Woodhouse | 166/21 |
| 2,703,316 | A | 3/1955 | Schneider | 260/78.3 |
| 2,869,642 | A | 1/1959 | McKay et al. | |
| 3,047,067 | A | 7/1962 | Williams et al. | 166/33 |
| 3,123,138 | A | 3/1964 | Robichaux | 166/33 |
| 3,176,768 | A | 4/1965 | Brandt et al. | 166/33 |
| 3,199,590 | A | 8/1965 | Young | 166/33 |

(Continued)

FOREIGN PATENT DOCUMENTS

CA 2063877 5/2003

(Continued)

OTHER PUBLICATIONS

U.S. Appl. No. 10/383,154, filed Mar. 6, 2003, Nguyen et al.

(Continued)

*Primary Examiner*—George Suchfield
(74) *Attorney, Agent, or Firm*—Robert A. Kent; Baker Botts LLC

(57) ABSTRACT

Methods of remediating a subterranean formation comprising directing vibrational waves at a portion of the subterranean formation containing fines; allowing the vibrational waves to displace at least a portion of the fines; and introducing a consolidating agent into the portion of the subterranean formation through a well bore that penetrates the portion of the subterranean formation.

24 Claims, 1 Drawing Sheet

U.S. PATENT DOCUMENTS

| | | | | |
|---|---|---|---|---|
| 3,272,650 | A | 9/1966 | MacVittie | 134/7 |
| 3,297,086 | A | 1/1967 | Spain | 166/33 |
| 3,308,885 | A | 3/1967 | Sandiford | 166/33 |
| 3,316,965 | A | 5/1967 | Watanabe | 166/33 |
| 3,375,872 | A | 4/1968 | McLaughlin et al. | 166/29 |
| 3,404,735 | A | 10/1968 | Young et al. | 166/33 |
| 3,415,320 | A | 12/1968 | Young | 166/33 |
| 3,492,147 | A | 1/1970 | Young et al. | 117/62.2 |
| 3,659,651 | A | 5/1972 | Graham | 166/280 |
| 3,681,287 | A | 8/1972 | Brown et al. | 260/67 |
| 3,754,598 | A | 8/1973 | Holloway, Jr. | 166/249 |
| 3,765,804 | A | 10/1973 | Brandon | 417/540 |
| 3,768,564 | A | 10/1973 | Knox et al. | 166/307 |
| 3,784,585 | A | 1/1974 | Schmitt et al. | 260/861 |
| 3,819,525 | A | 6/1974 | Hattenbrun | 252/132 |
| 3,828,854 | A | 8/1974 | Templeton et al. | 166/307 |
| 3,842,907 | A | 10/1974 | Baker et al. | 166/249 |
| 3,842,911 | A | 10/1974 | Know et al. | 166/307 |
| 3,854,533 | A | 12/1974 | Gurley et al. | 166/276 |
| 3,857,444 | A | 12/1974 | Copeland | 166/276 |
| 3,863,709 | A | 2/1975 | Fitch | 165/1 |
| 3,868,998 | A | 3/1975 | Lybarger et al. | 166/278 |
| 3,888,311 | A | 6/1975 | Cooke, Jr. | 166/280 |
| 3,912,692 | A | 10/1975 | Casey et al. | 260/78.3 |
| 3,948,672 | A | 4/1976 | Hamberger | 106/90 |
| 3,955,993 | A | 5/1976 | Curtice | 106/90 |
| 3,960,736 | A | 6/1976 | Free et al. | 252/8.55 R |
| 4,008,763 | A | 2/1977 | Lowe et al. | 166/253 |
| 4,029,148 | A | 6/1977 | Emery | 166/250.1 |
| 4,031,958 | A | 6/1977 | Sandiford et al. | 166/270 |
| 4,042,032 | A | 8/1977 | Anderson et al. | 166/276 |
| 4,070,865 | A | 1/1978 | McLaughlin | 61/36 |
| 4,074,760 | A | 2/1978 | Copeland et al. | 166/276 |
| 4,169,798 | A | 10/1979 | DeMartino | 252/8.55 R |
| 4,172,066 | A | 10/1979 | Zweigle et al. | 260/29.6 TA |
| 4,245,702 | A | 1/1981 | Haafkens et al. | 166/307 |
| 4,273,187 | A | 6/1981 | Satter et al. | 166/250 |
| 4,291,766 | A | 9/1981 | Davies et al. | 166/276 |
| 4,305,463 | A | 12/1981 | Zakiewicz | 106/245 |
| 4,336,842 | A | 6/1982 | Graham et al. | 166/276 |
| 4,352,674 | A | 10/1982 | Fery | 23/230 |
| 4,353,806 | A | 10/1982 | Canter et al. | 507/229 |
| 4,387,769 | A | 6/1983 | Erbstoesser et al. | 166/295 |
| 4,415,805 | A | 11/1983 | Fertl et al. | 250/260 |
| 4,439,489 | A | 3/1984 | Johnson et al. | 428/404 |
| 4,443,347 | A | 4/1984 | Underdown et al. | 252/8.55 R |
| 4,460,052 | A | 7/1984 | Gockel | 175/72 |
| 4,470,915 | A | 9/1984 | Conway | 252/8.55 R |
| 4,493,875 | A | 1/1985 | Beck et al. | 428/403 |
| 4,494,605 | A | 1/1985 | Wiechel et al. | 166/288 |
| 4,498,995 | A | 2/1985 | Gockel | 252/8.5 LC |
| 4,501,328 | A | 2/1985 | Nichols | 166/288 |
| 4,526,695 | A | 7/1985 | Erbstoesser et al. | 252/8.55 R |
| 4,527,627 | A | 7/1985 | Graham et al. | 166/280 |
| 4,541,489 | A | 9/1985 | Wu | 166/312 |
| 4,546,012 | A | 10/1985 | Brooks | 427/213 |
| 4,553,596 | A | 11/1985 | Graham et al. | 166/295 |
| 4,564,459 | A | 1/1986 | Underdown et al. | 252/8.55 R |
| 4,572,803 | A | 2/1986 | Yamazoe et al. | 534/16 |
| 4,649,998 | A | 3/1987 | Friedman | 166/294 |
| 4,664,819 | A | 5/1987 | Glaze et al. | 252/8.551 |
| 4,665,988 | A | 5/1987 | Murphey et al. | 166/295 |
| 4,669,543 | A | 6/1987 | Young | 166/276 |
| 4,675,140 | A | 6/1987 | Sparks et al. | 264/4.3 |
| 4,683,954 | A | 8/1987 | Walker et al. | 166/307 |
| 4,694,905 | A | 9/1987 | Armbruster | 166/280 |
| 4,715,967 | A | 12/1987 | Bellis et al. | 252/8.551 |
| 4,716,964 | A | 1/1988 | Erbstoesser et al. | 166/284 |
| 4,733,729 | A | 3/1988 | Copeland | 166/276 |
| 4,739,832 | A | 4/1988 | Jennings, Jr. et al. | 166/299 |
| 4,785,884 | A | 11/1988 | Armbruster | 166/280 |
| 4,787,453 | A | 11/1988 | Hewgill et al. | 166/272.3 |
| 4,789,105 | A | 12/1988 | Hosokawa et al. | 241/67 |
| 4,796,701 | A | 1/1989 | Hudson et al. | 166/278 |
| 4,797,262 | A | 1/1989 | Dewitz | 422/142 |
| 4,800,960 | A | 1/1989 | Friedman et al. | 166/276 |
| 4,809,783 | A | 3/1989 | Hollenbeck et al. | 166/307 |
| 4,817,721 | A | 4/1989 | Pober | 166/295 |
| 4,829,100 | A | 5/1989 | Murphey et al. | 523/131 |
| 4,838,352 | A | 6/1989 | Oberste-Padtberg et al. | 166/291 |
| 4,842,072 | A | 6/1989 | Friedman et al. | 166/295 |
| 4,846,118 | A | 7/1989 | Slattery et al. | 524/555 |
| 4,848,467 | A | 7/1989 | Cantu et al. | 166/281 |
| 4,848,470 | A | 7/1989 | Korpics | 166/312 |
| 4,850,430 | A | 7/1989 | Copeland et al. | 166/276 |
| 4,886,354 | A | 12/1989 | Welch et al. | 356/70 |
| 4,888,240 | A | 12/1989 | Graham et al. | 428/403 |
| 4,895,207 | A | 1/1990 | Friedman et al. | 166/276 |
| 4,903,770 | A | 2/1990 | Friedman et al. | 166/288 |
| 4,934,456 | A | 6/1990 | Moradi-Araghi | 166/270 |
| 4,936,385 | A | 6/1990 | Weaver et al. | 166/288 |
| 4,942,186 | A | 7/1990 | Murphey et al. | 523/131 |
| 4,957,165 | A | 9/1990 | Cantu et al. | 166/295 |
| 4,959,432 | A | 9/1990 | Fan et al. | 526/287 |
| 4,961,466 | A | 10/1990 | Himes et al. | 166/250 |
| 4,969,522 | A | 11/1990 | Whitehurst et al. | 166/278 |
| 4,969,523 | A | 11/1990 | Martin et al. | 166/278 |
| 4,986,353 | A | 1/1991 | Clark et al. | 166/279 |
| 4,986,354 | A | 1/1991 | Cantu et al. | 166/279 |
| 4,986,355 | A | 1/1991 | Casad et al. | 166/295 |
| 5,030,603 | A | 7/1991 | Rumpf et al. | 501/127 |
| 5,049,743 | A | 9/1991 | Taylor, III et al. | 250/303 |
| 5,082,056 | A | 1/1992 | Tackett, Jr. | 166/295 |
| 5,107,928 | A | 4/1992 | Hilterhaus | 166/293 |
| 5,128,390 | A | 7/1992 | Murphey et al. | 523/130 |
| 5,135,051 | A | 8/1992 | Facteau et al. | 166/104 |
| 5,142,023 | A | 8/1992 | Gruber et al. | 528/354 |
| 5,165,438 | A | 11/1992 | Facteau et al. | 137/1 |
| 5,173,527 | A | 12/1992 | Calve | 524/74 |
| 5,178,218 | A | 1/1993 | Dees | 166/281 |
| 5,182,051 | A | 1/1993 | Bandy et al. | 252/645 |
| 5,199,491 | A | 4/1993 | Kutta et al. | 166/276 |
| 5,199,492 | A | 4/1993 | Surles et al. | 166/295 |
| 5,211,234 | A | 5/1993 | Floyd | 166/276 |
| 5,216,050 | A | 6/1993 | Sinclair | 524/108 |
| 5,218,038 | A | 6/1993 | Johnson et al. | 524/541 |
| 5,232,955 | A | 8/1993 | Csabai et al. | 521/63 |
| 5,232,961 | A | 8/1993 | Murphey et al. | 523/414 |
| 5,238,068 | A | 8/1993 | Fredrickson | 166/307 |
| 5,247,059 | A | 9/1993 | Gruber et al. | 528/354 |
| 5,249,628 | A | 10/1993 | Surjaatmadia | 166/305 |
| 5,256,729 | A | 10/1993 | Kutta et al. | 524/700 |
| 5,273,115 | A | 12/1993 | Spafford | 166/281 |
| 5,285,849 | A | 2/1994 | Surles et al. | 166/295 |
| 5,293,939 | A | 3/1994 | Surles et al. | 166/295 |
| 5,295,542 | A | 3/1994 | Cole et al. | 166/278 |
| 5,320,171 | A | 6/1994 | Laramay | 166/285 |
| 5,321,062 | A | 6/1994 | Landrum et al. | 523/141 |
| 5,325,923 | A | 7/1994 | Surjaatmadja et al. | 166/308 |
| 5,330,005 | A | 7/1994 | Card et al. | 166/280 |
| 5,332,037 | A | 7/1994 | Schmidt et al. | 166/276 |
| 5,335,726 | A | 8/1994 | Rodrogues | 166/295 |
| 5,351,754 | A | 10/1994 | Hardin et al. | 166/249 |
| 5,358,051 | A | 10/1994 | Rodrigues | 166/295 |
| 5,359,026 | A | 10/1994 | Gruber | 528/354 |
| 5,360,068 | A | 11/1994 | Sprunt et al. | 166/259 |
| 5,361,856 | A | 11/1994 | Surjaatmadja et al. | 175/67 |
| 5,363,916 | A | 11/1994 | Himes et al. | 166/276 |
| 5,373,901 | A | 12/1994 | Norman et al. | 166/300 |
| 5,381,864 | A | 1/1995 | Nguyen et al. | 166/280 |
| 5,386,874 | A | 2/1995 | Laramay et al. | 166/300 |
| 5,388,648 | A | 2/1995 | Jordan, Jr. | 166/380 |
| 5,393,810 | A | 2/1995 | Harris et al. | 524/56 |
| 5,396,957 | A | 3/1995 | Surjaatmadja et al. | 166/308 |

5,402,846 A 4/1995 Jennings, Jr. et al. ..... 166/259
5,422,183 A 6/1995 Sinclair et al. ..... 428/403
5,423,381 A 6/1995 Surles et al. ..... 166/295
5,439,055 A 8/1995 Card et al. ..... 166/280
5,460,226 A 10/1995 Lawton et al. ..... 166/300
5,464,060 A 11/1995 Hale et al. ..... 166/293
5,475,080 A 12/1995 Gruber et al. ..... 528/354
5,484,881 A 1/1996 Gruber et al. ..... 528/54
5,494,103 A 2/1996 Surjaatmadja et al. ..... 166/222
5,494,178 A 2/1996 Nguyen et al. ..... 166/276
5,497,830 A 3/1996 Boles et al. ..... 166/300
5,498,280 A 3/1996 Fistner et al. ..... 106/19
5,499,678 A 3/1996 Surjaatmadja et al. ..... 166/298
5,501,275 A 3/1996 Card et al. ..... 166/280
5,505,787 A 4/1996 Yamaguchi ..... 134/4
5,512,071 A 4/1996 Yam et al. ..... 51/307
5,520,250 A 5/1996 Harry et al. ..... 166/278
5,522,460 A 6/1996 Shu ..... 166/295
5,529,123 A 6/1996 Carpenter et al. ..... 166/293
5,531,274 A 7/1996 Bienvenu, Jr. ..... 166/280
5,536,807 A 7/1996 Gruber et al. ..... 528/354
5,545,824 A 8/1996 Stengel et al. ..... 524/590
5,547,023 A 8/1996 McDaniel et al. ..... 166/280
5,551,513 A 9/1996 Suries et al. ..... 166/278
5,551,514 A 9/1996 Nelson et al. ..... 166/280
5,582,249 A 12/1996 Caveny et al. ..... 166/276
5,582,250 A 12/1996 Constien ..... 166/280
5,588,488 A 12/1996 Vijn et al. ..... 166/293
5,591,700 A 1/1997 Harris et al. ..... 507/204
5,594,095 A 1/1997 Gruber et al. ..... 528/354
5,595,245 A 1/1997 Scott, III ..... 166/250.1
5,597,784 A 1/1997 Sinclair et al.
5,604,184 A 2/1997 Ellis et al. ..... 507/117
5,604,186 A 2/1997 Hunt et al. ..... 507/204
5,609,207 A 3/1997 Dewprashad et al. ..... 166/276
5,620,049 A 4/1997 Gipson et al. ..... 166/248
5,639,806 A 6/1997 Johnson et al. ..... 523/208
5,670,473 A 9/1997 Scepanski ..... 510/445
5,697,440 A 12/1997 Weaver et al. ..... 166/281
5,698,322 A 12/1997 Tsai et al. ..... 428/373
5,712,314 A 1/1998 Surles et al. ..... 521/41
5,732,364 A 3/1998 Kalb et al. ..... 588/8
5,765,642 A 6/1998 Surjaatmadja ..... 166/297
5,775,425 A 7/1998 Weaver et al. ..... 166/276
5,782,300 A 7/1998 James et al. ..... 166/278
5,783,822 A 7/1998 Buchanan et al. ..... 250/259
5,787,986 A 8/1998 Weaver et al. ..... 166/280
5,791,415 A 8/1998 Nguyen et al. ..... 166/280
5,799,734 A 9/1998 Norman et al. ..... 166/278
5,806,593 A 9/1998 Suries ..... 166/270
5,830,987 A 11/1998 Smith ..... 528/332
5,833,000 A 11/1998 Weaver et al. ..... 166/276
5,833,361 A 11/1998 Funk ..... 366/80
5,836,391 A 11/1998 Jonasson et al. ..... 166/295
5,836,392 A 11/1998 Urlwin-Smith ..... 166/295
5,837,656 A 11/1998 Sinclair et al. ..... 507/220
5,837,785 A 11/1998 Kinsho et al. ..... 525/527
5,839,510 A 11/1998 Weaver et al. ..... 166/276
5,849,401 A 12/1998 El-Afandi et al. ..... 428/215
5,849,590 A 12/1998 Anderson, II et al. ..... 436/27
5,853,048 A 12/1998 Weaver et al. ..... 166/279
5,864,003 A 1/1999 Qureshi et al. ..... 528/141
5,865,936 A 2/1999 Edelman et al. ..... 156/310
5,871,049 A 2/1999 Weaver et al. ..... 166/276
5,873,413 A 2/1999 Chatterji et al. ..... 166/293
5,875,844 A 3/1999 Chatterji et al. ..... 166/293
5,875,845 A 3/1999 Chatterji et al. ..... 166/293
5,875,846 A 3/1999 Chatterji et al. ..... 166/293
5,893,383 A 4/1999 Facteau ..... 137/14
5,893,416 A 4/1999 Read ..... 166/304
5,908,073 A 6/1999 Nguyen et al. ..... 166/276
5,911,282 A 6/1999 Onan et al. ..... 175/72
5,916,933 A 6/1999 Johnson et al. ..... 523/208
5,921,317 A 7/1999 Dewprashad et al. ..... 166/208
5,924,488 A 7/1999 Nguyen et al. ..... 166/280
5,929,437 A 7/1999 Elliott et al. ..... 250/259
5,944,105 A 8/1999 Nguyen ..... 166/278
5,945,387 A 8/1999 Chatterji et al. ..... 507/224
5,948,734 A 9/1999 Sinclair et al. ..... 507/219
5,957,204 A 9/1999 Chatterji et al. ..... 166/295
5,960,880 A 10/1999 Nguyen et al. ..... 166/280
5,964,291 A 10/1999 Bourne et al. ..... 166/279
5,969,006 A 10/1999 Onan et al. ..... 523/166
5,969,523 A 10/1999 Chung et al. ..... 166/278
5,977,283 A 11/1999 Rossitto ..... 528/44
5,994,785 A 11/1999 Higuchi et al. ..... 527/789
RE36,466 E 12/1999 Nelson et al. ..... 166/280
6,003,600 A 12/1999 Nguyen et al. ..... 166/281
6,004,400 A 12/1999 Bishop et al. ..... 134/2
6,006,835 A 12/1999 Onan et al. ..... 166/295
6,006,836 A 12/1999 Chatterji et al. ..... 166/295
6,012,524 A 1/2000 Chatterji et al. ..... 166/295
6,016,870 A 1/2000 Dewprashad et al. ..... 166/295
6,024,170 A 2/2000 McCabe et al. ..... 166/300
6,028,113 A 2/2000 Scepanski ..... 514/643
6,028,534 A 2/2000 Ciglenec et al. ..... 340/856.2
6,040,398 A 3/2000 Kinsho et al. ..... 525/527
6,047,772 A 4/2000 Weaver et al. ..... 166/276
6,059,034 A 5/2000 Rickards et al. ..... 166/280
6,059,035 A 5/2000 Chatterji et al. ..... 166/293
6,059,036 A 5/2000 Chatterji et al. ..... 166/294
6,068,055 A 5/2000 Chatterji et al. ..... 166/293
6,069,117 A 5/2000 Onan et al. ..... 507/202
6,074,739 A 6/2000 Katagiri ..... 428/323
6,079,492 A 6/2000 Hoogteijling et al. ..... 166/276
6,098,711 A 8/2000 Chatterji et al. ..... 166/294
6,114,410 A 9/2000 Betzold ..... 523/130
6,123,871 A 9/2000 Carroll ..... 252/301.36
6,123,965 A 9/2000 Jacob et al. ..... 424/489
6,124,246 A 9/2000 Heathman et al. ..... 507/219
6,130,286 A 10/2000 Thomas et al. ..... 524/507
6,135,987 A 10/2000 Tsai et al. ..... 604/365
6,140,446 A 10/2000 Fujiki et al. ..... 528/15
6,148,911 A 11/2000 Gipson et al. ..... 166/248
6,152,234 A 11/2000 Newhouse et al. ..... 166/403
6,162,766 A 12/2000 Muir et al. ..... 507/267
6,169,058 B1 1/2001 Le et al. ..... 507/222
6,172,011 B1 1/2001 Card et al. ..... 507/204
6,172,077 B1 1/2001 Curtis et al. ..... 514/278
6,176,315 B1 1/2001 Reddy et al. ..... 166/295
6,177,484 B1 1/2001 Surles ..... 523/131
6,184,311 B1 2/2001 O'Keefe et al. ..... 525/438
6,187,834 B1 2/2001 Thayer et al. ..... 522/15
6,189,615 B1 2/2001 Sydansk ..... 166/270
6,192,985 B1 2/2001 Hinkel et al. ..... 166/280
6,192,986 B1 2/2001 Urlwin-Smith ..... 166/295
6,196,317 B1 3/2001 Hardy ..... 166/295
6,202,751 B1 3/2001 Chatterji et al. ..... 166/276
6,209,643 B1 4/2001 Nguyen et al. ..... 166/276
6,209,644 B1 4/2001 Brunet ..... 166/297
6,209,646 B1 4/2001 Reddy et al. ..... 166/300
6,210,471 B1 4/2001 Craig ..... 106/31.08
6,214,773 B1 4/2001 Harris et al. ..... 507/271
6,231,644 B1 5/2001 Chatterji et al. ..... 106/724
6,234,251 B1 5/2001 Chatterji et al. ..... 166/295
6,238,597 B1 5/2001 Yim et al. ..... 252/512
6,241,019 B1 6/2001 Davidson et al. ..... 166/249
6,242,390 B1 6/2001 Mitchell et al. ..... 507/211
6,244,344 B1 6/2001 Chatterji et al. ..... 166/295
6,257,335 B1 7/2001 Nguyen et al. ..... 166/280
6,260,622 B1 7/2001 Blok et al. ..... 166/305.1
6,271,181 B1 8/2001 Chatterji et al. ..... 507/219
6,274,650 B1 8/2001 Cui ..... 523/457
6,279,652 B1 8/2001 Chatterji et al. ..... 166/194
6,279,656 B1 8/2001 Sinclair et al. ..... 166/310
6,283,214 B1 9/2001 Guinot et al. ..... 166/297

6,302,207 B1 10/2001 Nguyen et al. ..... 166/276
6,306,998 B1 10/2001 Kimura et al. ..... 528/12
6,311,773 B1 11/2001 Todd et al. ..... 166/280
6,321,841 B1 11/2001 Eoff et al. ..... 166/291
6,323,307 B1 11/2001 Bigg et al. ..... 528/354
6,326,458 B1 12/2001 Gruber et al. ..... 528/354
6,328,105 B1 12/2001 Betzold ..... 166/280
6,328,106 B1 12/2001 Griffith et al. ..... 166/295
6,330,916 B1 12/2001 Rickards et al. ..... 166/280
6,330,917 B2 12/2001 Chatterji et al. ..... 166/295
6,350,309 B2 2/2002 Chatterji et al. ..... 106/677
6,357,527 B1 3/2002 Norman et al. ..... 166/300
6,364,018 B1 4/2002 Brannon et al. ..... 166/280.2
6,364,945 B1 4/2002 Chatterji et al. ..... 106/677
6,367,165 B1 4/2002 Huttlin ..... 34/582
6,367,549 B1 4/2002 Chatterji et al. ..... 166/292
6,372,678 B1 4/2002 Youngsman et al. ..... 504/128
6,376,571 B1 4/2002 Chawla et al. ..... 522/64
6,387,986 B1 5/2002 Moradi-Araghi et al. .... 523/211
6,390,195 B1 5/2002 Nguyen et al. ..... 166/276
6,401,817 B1 6/2002 Griffith et al. ..... 166/295
6,405,797 B2 6/2002 Davidson et al. ..... 166/249
6,406,789 B1 6/2002 McDaniel et al. ..... 428/403
6,408,943 B1 6/2002 Schultz et al. ..... 166/285
6,422,314 B1 7/2002 Todd et al. ..... 166/312
6,439,309 B1 8/2002 Matherly et al. ..... 166/276
6,439,310 B1 8/2002 Scott, III et al. ..... 166/308
6,440,255 B1 8/2002 Kohlhammer et al. ..... 156/283
6,446,727 B1 9/2002 Zemlak et al. ..... 166/308
6,448,206 B1 9/2002 Griffith et al. ..... 507/219
6,450,260 B1 9/2002 James et al. ..... 166/277
6,454,003 B1 9/2002 Chang et al. ..... 166/270
6,458,885 B1 10/2002 Stengal et al. ..... 524/507
6,485,947 B1 11/2002 Rajgarhia et al. ..... 435/139
6,488,091 B1 12/2002 Weaver et al. ..... 166/300
6,488,763 B2 12/2002 Brothers et al. ..... 106/692
6,494,263 B2 12/2002 Todd ..... 166/312
6,503,870 B2 1/2003 Griffith et al. ..... 507/219
6,508,305 B1 1/2003 Brannon et al. ..... 166/293
6,527,051 B1 3/2003 Reddy et al. ..... 166/300
6,528,157 B1 3/2003 Hussain et al. ..... 428/325
6,531,427 B1 3/2003 Shuchart et al. ..... 507/267
6,538,576 B1 3/2003 Schultz et al. ..... 340/859.6
6,543,545 B1 4/2003 Chatterji et al. ..... 166/381
6,552,333 B1 4/2003 Storm et al. ..... 250/269.3
6,554,071 B1 4/2003 Reddy et al. ..... 166/293
6,555,507 B2 4/2003 Chatterji et al. ..... 507/219
6,569,814 B1 5/2003 Brady et al. ..... 507/201
6,582,819 B2 6/2003 McDaniel et al. ..... 428/402
6,593,402 B2 7/2003 Chatterji et al. ..... 524/7
6,599,863 B1 7/2003 Palmer et al. ..... 507/219
6,608,162 B1 8/2003 Chiu et al. ..... 528/129
6,616,320 B2 9/2003 Huber et al. ..... 366/156.2
6,620,857 B2 9/2003 Valet ..... 522/42
6,626,241 B2 9/2003 Nguyen ..... 166/278
6,632,527 B1 10/2003 McDaniel et al. ..... 428/402
6,632,892 B2 10/2003 Rubinsztajn et al. ..... 525/476
6,642,309 B2 11/2003 Komitsu et al. ..... 525/100
6,648,501 B2 11/2003 Huber et al. ..... 366/301
6,659,179 B2 12/2003 Nguyen ..... 166/227
6,664,343 B2 12/2003 Narisawa et al. ..... 525/474
6,667,279 B1 12/2003 Hessert et al. ..... 507/225
6,668,926 B2 12/2003 Nguyen et al. ..... 166/280
6,669,771 B2 12/2003 Tokiwa et al. ..... 106/162.7
6,681,856 B1 1/2004 Chatterji et al. ..... 166/294
6,686,328 B1 2/2004 Binder ..... 510/446
6,705,400 B1 3/2004 Nguyen et al. ..... 166/281
6,710,019 B1 3/2004 Sawdon et al. ..... 507/136
6,713,170 B1 3/2004 Kaneko et al. ..... 428/323
6,725,926 B2 4/2004 Nguyen et al. ..... 166/254.1
6,725,931 B2 4/2004 Nguyen et al. ..... 166/280.2
6,729,404 B2 5/2004 Nguyen et al. ..... 166/280.2
6,732,800 B2 5/2004 Acock et al. ..... 166/308
6,745,159 B1 6/2004 Todd et al. ..... 703/10
6,749,025 B1 6/2004 Brannon et al. ..... 166/305.1
6,763,888 B1 7/2004 Harris et al. ..... 166/305.1
6,766,858 B2 7/2004 Nguyen et al. ..... 166/300
6,776,236 B1 8/2004 Nguyen ..... 166/279
6,832,650 B2 12/2004 Nguyen et al. ..... 166/279
6,832,655 B2 * 12/2004 Ravensbergen et al. ..... 166/311
6,851,474 B2 2/2005 Nguyen ..... 166/279
6,887,834 B2 5/2005 Nguyen et al. ..... 507/221
7,025,134 B2 * 4/2006 Byrd et al. ..... 166/105
7,114,560 B2 * 10/2006 Nguyen et al. ..... 166/249
7,131,491 B2 * 11/2006 Blauch et al. ..... 166/276
2001/0016562 A1 8/2001 Muir et al. ..... 507/201
2002/0043370 A1 4/2002 Poe ..... 166/250.07
2002/0048676 A1 4/2002 McDaniel et al. ..... 428/404
2002/0070020 A1 6/2002 Nguyen ..... 166/295
2003/0006036 A1 1/2003 Malone et al. ..... 166/250.12
2003/0060374 A1 3/2003 Cooke, Jr. ..... 507/200
2003/0114314 A1 6/2003 Ballard et al. ..... 507/100
2003/0130133 A1 7/2003 Vollmer ..... 507/100
2003/0131999 A1 7/2003 Nguyen et al. ..... 166/280
2003/0148893 A1 8/2003 Lungofer et al. ..... 507/200
2003/0186820 A1 10/2003 Thesing ..... 507/200
2003/0188766 A1 10/2003 Banerjee et al. ..... 134/7
2003/0188872 A1 10/2003 Nguyen et al. ..... 166/308
2003/0196805 A1 10/2003 Boney et al. ..... 166/280
2003/0205376 A1 11/2003 Ayoub et al. ..... 166/254.2
2003/0230408 A1 12/2003 Acock et al. ..... 166/297
2003/0234103 A1 12/2003 Lee et al. ..... 166/293
2004/0000402 A1 1/2004 Nguyen et al. ..... 166/280
2004/0014607 A1 1/2004 Sinclair et al. ..... 507/200
2004/0014608 A1 1/2004 Nguyen et al. ..... 507/200
2004/0040706 A1 3/2004 Hossaini et al. ..... 166/278
2004/0040708 A1 3/2004 Stephenson et al. ..... 166/280.1
2004/0040713 A1 3/2004 Nguyen et al. ..... 166/295
2004/0048752 A1 3/2004 Nguyen et al. ..... 507/269
2004/0055747 A1 3/2004 Lee ..... 166/278
2004/0106525 A1 6/2004 Willbert et al. ..... 507/200
2004/0138068 A1 7/2004 Rimmer et al. ..... 507/100
2004/0149441 A1 8/2004 Nguyen et al. ..... 166/280.1
2004/0152601 A1 8/2004 Still et al. ..... 507/100
2004/0177961 A1 9/2004 Nguyen et al. ..... 166/280.2
2004/0194961 A1 10/2004 Nguyen et al. ..... 166/295
2004/0206499 A1 10/2004 Nguyen et al. ..... 166/280.2
2004/0211559 A1 10/2004 Nguyen et al. ..... 166/276
2004/0211561 A1 10/2004 Nguyen et al. ..... 166/280.2
2004/0221992 A1 11/2004 Nguyen et al. ..... 166/295
2004/0231845 A1 11/2004 Cooke, Jr. ..... 166/279
2004/0231847 A1 11/2004 Nguyen et al. ..... 166/295
2004/0256097 A1 12/2004 Bryd et al. ..... 166/105
2004/0256099 A1 12/2004 Nguyen et al. ..... 166/249
2004/0261995 A1 12/2004 Nguyen et al. ..... 166/279
2004/0261997 A1 12/2004 Nguyen et al. ..... 166/281
2005/0000731 A1 1/2005 Nguyen et al. ..... 175/57
2005/0006093 A1 1/2005 Nguyen et al. ..... 166/281
2005/0006096 A1 1/2005 Nguyen et al. ..... 166/295
2005/0045326 A1 3/2005 Nguyen ..... 166/278
2005/0214147 A1 9/2005 Schultz et al. ..... 417/503
2005/0274517 A1 12/2005 Blauch et al. ..... 166/280.2
2005/0277554 A1 12/2005 Blauch et al. ..... 507/224

FOREIGN PATENT DOCUMENTS

EP 0313243 B1 10/1988
EP 0528595 A1 8/1992
EP 0510762 A2 11/1992
EP 0643196 A2 6/1994
EP 0834644 A2 4/1998
EP 0853186 A2 7/1998
EP 0864726 A2 9/1998
EP 0879935 B1 11/1998
EP 0933498 A1 8/1999
EP 1001133 A1 5/2000

| | | | |
|---|---|---|---|
| EP | 1132569 | A2 | 9/2001 |
| EP | 1326003 | A1 | 7/2003 |
| EP | 1362978 | A1 | 11/2003 |
| EP | 1394355 | A1 | 3/2004 |
| EP | 1396606 | A2 | 3/2004 |
| EP | 1398460 | A1 | 3/2004 |
| EP | 1403466 | A2 | 3/2004 |
| EP | 1464789 | A1 | 10/2004 |
| GB | 1292718 | | 10/1972 |
| GB | 2382143 | A | 4/2001 |
| WO | WO 93/15127 | | 8/1993 |
| WO | WO 94/07949 | | 4/1994 |
| WO | WO 94/08078 | | 4/1994 |
| WO | WO 94/08090 | | 4/1994 |
| WO | WO 95/09879 | | 4/1995 |
| WO | WO 97/11845 | | 4/1997 |
| WO | WO 99/27229 | | 6/1999 |
| WO | WO 01/81914 | | 11/2001 |
| WO | WO 01/87797 | A1 | 11/2001 |
| WO | WO 02/12674 | A1 | 2/2002 |
| WO | WO 03/027431 | A1 | 4/2003 |
| WO | WO 03/027431 | A2 | 4/2003 |
| WO | WO 04/037946 | A1 | 5/2004 |
| WO | WO 04/038176 | A1 | 5/2004 |
| WO | WO 05/021928 | A2 | 3/2005 |

OTHER PUBLICATIONS

U.S. Appl. No. 10/394,898, filed Mar. 21, 2003, Eoff et al.
U.S. Appl. No. 10/408,800, filed Apr. 7, 2003, Nguyen et al.
U.S. Appl. No. 10/601,407, filed Jun. 23, 2003, Byrd et al.
U.S. Appl. No. 10/603,492, filed Jun. 25, 2003, Nguyen et al.
U.S. Appl. No. 10/649,029, filed Aug. 27, 2003, Nguyen et al.
U.S. Appl. No. 10/650,063, filed Aug. 26, 2003, Nguyen et al.
U.S. Appl. No. 10/650,064, filed Aug. 26, 2003, Nguyen et al.
U.S. Appl. No. 10/650,065, filed Aug. 26, 2003, Nguyen et al.
U.S. Appl. No. 10/659,574, filed Sep. 10, 2003, Nguyen et al.
U.S. Appl. No. 10/727,365, filed Dec. 4, 2003, Reddy et al.
U.S. Appl. No. 10/751,593, filed Jan. 5, 2004, Nguyen et al.
U.S. Appl. No. 10/775,347, filed Feb. 10, 2004, Nguyen.
U.S. Appl. No. 10/791,944, filed Mar. 3, 2004, Nguyen.
U.S. Appl. No. 10/793,711, filed Mar. 5, 2004, Nguyen et al.
U.S. Appl. No. 10/852,811, filed May 25, 2004, Nguyen.
U.S. Appl. No. 10/853,879, filed May 26, 2004, Nguyen et al.
U.S. Appl. No. 10/860,951, filed Jun. 4, 2004, Stegent et al.
U.S. Appl. No. 10/861,829, filed Jun. 4, 2004, Stegent et al.
U.S. Appl. No. 10/862,986, filed Jun. 8, 2004, Nguyen et al.
U.S. Appl. No. 10/864,061, filed Jun. 9, 2004, Blauch et al.
U.S. Appl. No. 10/864,618, filed Jun. 9, 2004, Blauch et al.
U.S. Appl. No. 10/868,593, filed Jun. 15, 2004, Nguyen et al.
U.S. Appl. No. 10/868,608, filed Jun. 15, 2004, Nguyen et al.
U.S. Appl. No. 10/937,076, filed Sep. 9, 2004, Nguyen et al.
U.S. Appl. No. 10/944,973, filed Sep. 20, 2004, Nguyen et al.
U.S. Appl. No. 10/953,237, filed Sep. 29, 2004, Birchak et al.
U.S. Appl. No. 10/972,648, filed Oct. 25, 2004, Dusterhoft et al.
U.S. Appl. No. 10/977,673, filed Oct. 29, 2004, Nguyen et al.
U.S. Appl. No. 11/009,277, filed Dec. 8, 2004, Welton et al.
U.S. Appl. No. 11/011,394, filed Dec. 12, 2004, Nguyen et al.
U.S. Appl. No. 11/035,833, filed Jan. 14, 2005, Nguyen.
U.S. Appl. No. 11/049,252, filed Feb. 2, 2005, Van Batenburg et al.
U.S. Appl. No. 11/053,280, filed Feb. 8, 2005, Nguyen.
U.S. Appl. No. 11/056,635, filed Feb. 11, 2005, Dusterhoft et al.
U.S. Appl. No. 11/285,686, filed Nov. 22, 2005, Stegent et al.
Halliburton, *CoalStim$^{SM}$ Service, Helps Boost Cash Flow From CBM Assets*, Stimulation, HO3679 Oct. 2003, Halliburton Communications.
Halliburton, *Conductivity Endurance Technology For High Permeability Reservoirs, Helps Prevent Intrusion of Formation Material Into the Proppant Pack for Improved Long-term Production*, Stimulation, 2003, Halliburton Communications.
Halliburton, *Expedite© Service, A Step-Change Improvement Over Conventional Proppant Flowback Control Systems. Provides Up to Three Times the Conductivity of RCPs.*, Stimulation, HO3296 May 2004, Halliburton Communications.
Halliburton Technical Flier—Multi Stage Frac Completion Methods, 2 pages.
Halliburton "*CobraFrac$^{SM}$ Service, Coiled Tubing Fracturing—Cost-Effective Method for Stimulating Untapped Reserves*", 2 pages, 2004.
Halliburton "*CobraJetFrac$^{SM}$ Service, Cost-Effective Technology That Can Help Reduce Cost per BOE Produced, Shorten Cycle time and Reduce Capex*".
Halliburton Cobra Frac Advertisement, 2001.
Halliburton "*SurgiFrac$^{SM}$ Service, a Quick and cost-Effective Method to Help Boost Production From Openhole Horizonal Completions*", 2002.
Halliburton, *SandWedge® NT Conductivity Enhancement System, Enhances Proppant Pack Conductivity and Helps Prevent Intrusion of Formation Material for Improved Long-Term Production*, Stimulation, HO2289 May 2004, Halliburton Communications, 2004.
Almond et al., *Factors Affecting Proppant Flowback With Resin Coated Proppants*, SPE 30096, pp. 171-186, May 1995.
Nguyen et al., *A Novel Approach For Enhancing Proppant Consolidation: Laboratory Testing And Field Applications*, SPE Paper No. 77748, 2002.
SPE 15547, *Field Application of Lignosulfonate Gels To Reduce Channeling*, South Swan Hills Miscible Unit, Alberta, Canada, by O.R. Wagner et al, 1986.
Owens et al., *Waterflood Pressure Pulsing for Fractured Reservoirs* SPE 1123, 1966.
Felsenthal et al., *Pressure Pulsing—An Improved Method of Waterflooding Fractured Reservoirs* SPE 1788, 1957.
Raza, "*Water and Gas Cyclic Pulsing Method for Improved Oil Recovery*", SPE 3005, 1971.
Peng et al., "*Pressure Pulsing Waterflooding in Dual Porosity Naturally Fractured Reservoirs*" SPE 17587, 1988.
Dusseault et al, "*Pressure Pulse Workovers in Heavy* Oil", SPE 79033, 2002.
Yang et al., "*Experimental Study on Fracture Initiation By Pressure Pulse*", SPE 63035, 2000.
Nguyen et al., *New Guidelines For Applying Curable Resin-Coated Proppants*, SPE Paper No. 39582, 1997.
Kazakov et al., "*Optimizing and Managing Coiled Tubing Frac Strings"* SPE 60747, 2000
Advances in Polymer Science, vol. 157, "*Degradable Aliphatic Polyesters"* edited y A.-C. Albertson, pp. 1-138, 2001.
Gorman, *Plastic Electric: Lining up the Future of Conducting Polymers* Science News, vol. 163, May 17, 2003.
Gidley et al., "*Recent Advances in Hydraulic Fracturing*," Chapter 6, pp. 109-130, 1989.
Simmons et al., "*Poly(phenyllactide): Synthesis, Characterization, and Hydrolytic Degradation, Biomacromolecules*", vol. 2, No. 2, pp. 658-663, 2001.
Yin et al., "*Preparation and Characterization of Substituted Polylactides*", Americal Chemical Society, vol. 32, No. 23, pp. 7711-7718, 1999.
Yin et al., "*Synthesis and Properties of Polymers Derived from Substituted Lactic Acids*", American Chemical Society, Ch.12, pp. 147-159, 2001.
Cantu et al., "*Laboratory and Field Evaluation of a Combined Fluid-Loss Control Additive and Gel Breaker for Fracturing Fluids*" SPE 18211, 1990.
Love et al., "*Selectively Placing Many Fractures in Openhole Horizontal Wells Improves Production*", SPE 50422, 1998.
McDaniel et al. "*Evolving New Stimulation Process Proves Highly Effective In Level 1 Dual-Lateral Completion*" SPE 78697, 2002.
Dechy-Cabaret et al., "*Controlled Ring-Operated Polymerization of Lactide and Glycolide*" American Chemical Society, Chemical Reviews, A-Z, AA-AD, 2004.
Funkhouser et al., "*Synthetic Polymer Fracturing Fluid For High-Temperature Applications*", SPE 80236, 2003.
*Chelating Agents*, Encyclopedia of Chemical Technology, vol. 5 (764-795).

Vichaibun et al., "*A New Assay for the Enzymatic Degradation of Polylactic Acid, Short Report*", ScienceAsia, vol. 29, pp. 297-300, 2003.
CDX Gas, CDX Solution, 2003, CDX, LLC, Available @ www.cdxgas.com/solution.html, printed pp. 1-2.
Halliburton brochure entitled "H2Zero™ Service Introducing The Next Generation of cost-Effective Conformance Control Solutions", 2002.
Halliburton brochure entitled ""Injectrol® A Component, 1999.
Halliburton brochure entitled "Injectrol® G Sealant", 1999.
Halliburton brochure entitled "Injectrol® It Sealant", 1999.
Halliburton brochure entitled "Injectrol® Service Treatment", 1999.
Halliburton brochure entitled "Injectrol® U Sealant" 1999.
Halliburton brochure entitled "Sanfix® A Resin", 1999.

* cited by examiner

REMEDIATION OF SUBTERRANEAN FORMATIONS USING VIBRATIONAL WAVES AND CONSOLIDATING AGENTS

CROSS-REFERENCE TO RELATED APPLICATIONS

This application is a continuation-in-part of U.S. Pat. No. 7,114,560 application Ser. No. 10/863,706 filed Jun. 8, 2004, which is a continuation-in-part of U.S. Pat. No. 7,025,134 application Ser. No. 10/601,407 filed Jun. 23, 2003, the entire disclosures of which are incorporated herein by reference.

BACKGROUND

The present invention relates to methods for treating a subterranean formation. More particularly, the present invention relates to the use of vibrational waves in combination with a consolidating agent in remedial treatments of a subterranean formation.

In a typical subterranean well, damage to the surrounding formation can impede fluid flow and may cause production levels to drop. While many damage mechanisms plague wells, one of the most pervasive problems is fines clogging formation pores that usually allow hydrocarbon flow. As used herein, the term "fines" refers to loose particles, such as formation fines, formation sand, clay particulates, coal fines, resin particulates, crushed proppant or gravel particulates, and the like. These fines can also obstruct fluid flow pathways in screens; preslotted, predrilled, or cemented and perforated liners; and gravel packs that may line a well. Fines may even restrict fluid flow in openhole wells. For example, in situ fines mobilized during production can lodge themselves in formation pores, preslotted liners, screens, and gravel packs, preventing or reducing fluid flow there through.

Well-stimulation techniques have been developed to at least mitigate the problems caused by fines. One such technique is matrix acidizing. In matrix acidizing, pumps may inject thousands of gallons of acid into the well to dissolve away precipitates, fines, or scale on the inside of tubulars, in the pores of a screen or gravel pack, or inside the formation. Any tool, screen, liner, or casing that comes into contact with the acid should be protected from its corrosive effects. A corrosion inhibitor generally is used to prevent tubulars from corrosion. Also, the acid must be removed from the well. Often, the well must also be flushed with pre- and post-acid solutions. Aside from the difficulties of determining the proper chemical composition for these fluids and pumping them down the well, the environmental costs of matrix acidizing can render the process undesirable. Additionally, maxtrix acidizing treatments generally only provide a temporary solution to these problems. Screens, preslotted liners, and gravel packs may also be flushed with a brine solution to remove solid particles. While this brine treatment is cheap and relatively easy to complete, it offers only a temporary and localized respite from the plugging fines. Moreover, frequent flushing can damage the formation and further decrease production.

Acoustic stimulation is another technique that has been developed as an alternative to address these problems. In acoustic stimulation used for near-borehole cleaning, vibrational waves transfer vibrational energy to the fines clogging formation pores. In some instances, these vibrational waves may be generated using a pulsonic device, such as a fluidic oscillator. The ensuing vibration of the fines displace them from the pores, thereby allowing increased fluid flow there through. Fluid flow, including production-fluid flow out of the formation or injection-fluid flow into the formation from the well, may cause the particles to migrate out of the pores, clearing the way for greater fluid flow. Acoustic stimulation may also be used to clean preslotted liners, screens, and gravel packs.

SUMMARY

The present invention relates to methods for treating a subterranean formation. More particularly, the present invention relates to the use of vibrational waves in combination with a consolidating agent in remedial treatments of a subterranean formation.

An embodiment of the present invention provides a method comprising: directing vibrational waves at a portion of a subterranean formation containing fines; allowing the vibrational waves to displace at least a portion of the fines; and introducing a consolidating agent into the portion of the subterranean formation through a well bore that penetrates the portion of the subterranean formation.

Another embodiment of the present invention provides a method of remediating a subterranean particulate pack comprising: directing vibrational waves at the particulate pack, the particulate pack containing fines; allowing the vibrational waves to displace at least a portion of the fines; and introducing a consolidating agent into the well bore so as to contact the particulate pack.

Yet another embodiment of the present invention provides a method of remediating a subterranean formation: generating vibrational waves in a consolidating agent by flowing the consolidating agent through a fluidic oscillator located in a well bore that penetrates the subterranean formation; introducing the consolidating agent into a portion of the subterranean formation containing fines; and allowing the vibrational waves in the consolidating agent to displace at least a portion of the fines so as to increase fluid flow through the portion of the subterranean formation.

The features and advantages of the present invention will be apparent to those skilled in the art. While numerous changes may be made by those skilled in the art, such changes are within the spirit of the invention.

BRIEF DESCRIPTION OF THE DRAWINGS

These drawings illustrate certain aspects of some of the embodiments of the present invention and should not be used to limit or define the invention.

DESCRIPTION OF PREFERRED EMBODIMENTS

Figure 1:
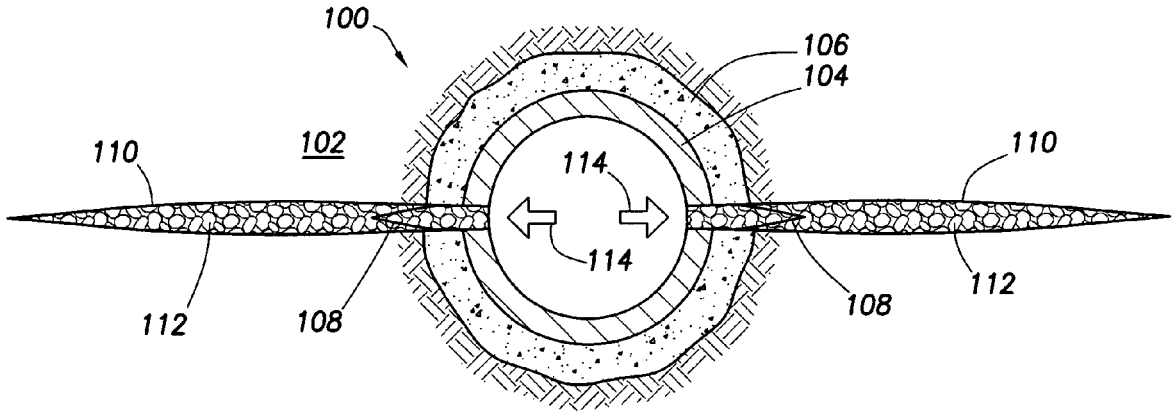
FIG. 1 illustrates a cross-sectional top view of a subterranean formation containing a proppant pack being treated in accordance with one embodiment of the present invention.

The present invention relates to methods for treating a subterranean formation. More particularly, the present invention relates to the use of vibrational waves in combination with a consolidating agent in remedial treatments of a subterranean formation.

I. Example Methods Of The Present Invention

The present invention provides methods of remediating a subterranean formation. An example of such a method comprises directing vibrational waves at a portion of the subterranean formation containing fines; allowing the vibrational waves to displace at a least a portion of the fines; and introducing a consolidating agent into the portion of the subterranean formation through a well bore that penetrates the portion of the portion of the subterranean formation. The methods of the present invention are suitable for use in production and injection wells.

According to the methods of the present invention, vibrational waves are directed at a portion of a subterranean formation so as to displace at least at least a portion of the fines located therein. In some embodiments, the portion of the subterranean formation may comprise a particulate pack (e.g., a proppant pack, a gravel pack, etc.); a preslotted, predrilled, or cemented and perforated liner; a sand control screen; and combinations thereof. These fines located within the portion of the subterranean formation may impede the flow of fluids through pores and/or fluid flow pathways in the subterranean formation. Generally, the vibrational energy should displace the fines so as to increase the flow of fluids through the portion of the subterranean formation.

The methods of the present invention also include the introduction of a consolidating agent into the portion of the subterranean formation. As used herein, the term "consolidating agent" refers to a composition that enhances the grain-to-grain (or grain-to-formation) contact between particulates (e.g., proppant particulates, gravel particulates, formation fines, coal fines, etc.) within a portion of the subterranean formation so that the particulates are stabilized, locked in place, or at least partially immobilized such that they are resistant to flowing with fluids. When placed into the subterranean formation, the consolidating agent should inhibit the fines that have been displaced by the vibrational waves from migrating with subsequently produced or injected fluids. In some embodiments, the consolidating agent may also carry these fines away from the well bore during the introduction of the consolidating agent into the portion. In some embodiments, the consolidating agent may be introduced into the portion of the subterranean formation during, or after, the direction of the vibrational waves at the portion of the subterranean formation. In some embodiments, the vibrational waves may be transferred to the portion of the subterranean formation through the consolidating agent. For example, the vibrational waves may be generated in the consolidating agent.

Referring now to FIG. 1, well bore 100 is shown that penetrates subterranean formation 102. Casing 104 may be located in well bore 100, as shown in FIG. 1 or, in some embodiments, well bore 100 may be openhole. In some embodiments, casing 104 may extend from the ground surface (not shown) into well bore 100. In some embodiments, casing 104 may be connected to the ground surface (not shown) by intervening casing (not shown), such as surface casing and conductor pipe. Casing 104 may or may not be cemented to subterranean formation with cement sheath 106.

Well bore 100 contains perforations 108 in communication with subterranean formation 102. Perforations 108 extend from well bore 100 into the portion of subterranean formation 102 adjacent thereto. In the cased embodiments, as shown in FIG. 1, perforations 108 extend from well bore 100, through casing 104, and cement sheath 106 (if any), and into subterranean formation 102. Fracture 110 extends from perforations 108 into subterranean formation 102. Proppant pack 112 is shown located in fracture 110. Proppant pack 112 comprises proppant particulates that have been packed in fracture 110. Fines (not shown) are disposed within the interstitial spaces of the proppant particulates forming proppant pack 112. These fines reduce the flow of fluids through proppant pack 112 to well bore 100 by plugging fluid flow pathways in proppant pack 112.

In accordance with one embodiment of the present invention, vibrational waves may be directed at proppant pack 112 from well bore 100 in the direction along arrow 114. While FIG. 1 depicts the vibrational waves being directed at proppant pack 112, it should be understood that the vibrational waves may be directed at additional portions (e.g., sequentially and/or simultaneously) of subterranean formation 102. In some embodiments, vibrational waves may be directed at the entire circumference of well bore 100. The vibrational waves should cause the fines disposed in the interstitial spaces of proppant pack 112 to vibrate. This vibration should cause at least a portion of fines to displace from the positions that are plugging fluid flow pathways in proppant pack 112. The consolidating agent may be introduced into proppant pack 112 through well bore 100. Sufficient consolidating agent should be used so that consolidating agent flows from well bore 100 into proppant pack 112 and then into subterranean formation 102. The consolidating agent should inhibit the displaced fines from migrating with subsequently produced or injected fluids. In some embodiments, the consolidating agent may also carry the displaced fines away from well bore 100 during the introduction of the consolidating agent into proppant pack 112.

Figure 2:
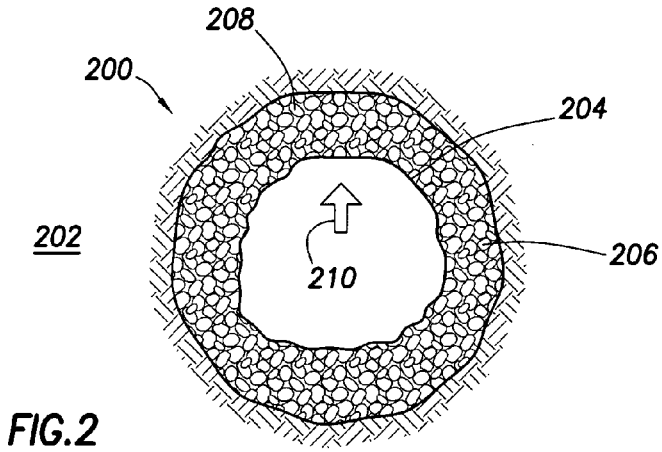
FIG. 2 illustrates a cross-sectional top view of a subterranean formation containing a gravel pack being treated in accordance with one embodiment of the present invention.

Referring now to FIG. 2, well bore 200 is shown that penetrates subterranean formation 202. Sand control screen 204 is shown located in well bore 200. Annulus 206 is formed between sand control screen 204 and the interior wall of well bore 200. Even though FIG. 2 depicts a sand control screen, the methods of the present invention may be used with a variety of suitable sand control equipment, including screens, liners (e.g., slotted liners, perforated liners, etc.), combinations of screens and liners, and any other suitable apparatus. Sand control screen 204 may be a wire-wrapped or expandable screen or any other suitable sand control screen. Gravel pack 208 is shown located in well bore 200. Gravel pack 208 comprises gravel particulates that have been packed in annulus 206 between sand control screen 204 and the interior wall of well bore 200.

In accordance with one embodiment of the present invention, vibrational waves may be directed at gravel pack 208 from well bore 200 in the direction along arrow 210. While FIG. 2 depicts gravel pack 208 in an open hole well bore, gravel packs also may be contained in a cased well bore. While FIG. 2 depicts the vibrational waves being directed at one location of gravel pack 208, it should be understood that the vibrational waves may be directed at one or more portions (e.g., sequentially or simultaneously) of gravel pack 208. In some embodiments, vibrational waves may be directed at the entire circumference of gravel pack 208. This vibration should cause at least a portion of fines to displace from the position that is plugging fluid flow pathways in gravel pack 208. The consolidating agent may be introduced into gravel pack 208 through well bore 200. Sufficient consolidating agent should be used so that consolidating agent flows from well bore 200 into gravel pack 208 and then into subterranean formation 202. The consolidating agent should inhibit the displaced fines from migrating with subsequently produced or injected fluids. In some embodiments, the consolidating agent may also carry the displaced fines away from well bore 200 during the introduction of the consolidating agent into gravel pack 208.

II. Vibrational Waves

Any suitable apparatus and/or methodology for directing vibrational waves at a portion of the subterranean formation may be suitable for use in the methods of the present invention. Generally, the vibrational waves should be sufficient to provide the desired displacement of fines without fracturing the portion of the subterranean formation. Suitable methods for directing vibrational waves include the use of acoustic stimulation tools and by applying a pressure pulse to a fluid introduced into the portion of the subterranean formation. In most embodiments, the vibrational waves are transferred to the portion of the subterranean formation through a fluid in the well bore. In some embodiments, the fluid may be the consolidating agent.

Acoustic stimulation tools generally involve a source of vibrational waves that transfer vibrational energy to the portion of the subterranean formation. The source of vibrational waves may be employed at the surface or in the well bore. Examples vibrational wave sources, include, but are not limited to, pistons, tuning forks, cantilever bars, wobble plates, oval-mode acoustic wave sources, and combinations thereof. An example of a suitable acoustic stimulation tool is described in U.S. Patent Application PG Publication No. 2005/0214147, the entire disclosure of which is incorporated herein by reference.

"Pressure pulsing," as used herein, refers to the application of periodic increases, or "pulses" in the pressure of a fluid introduced into the formation so as to deliberately vary fluid pressure applied to the formation. Pressure pulsing generally generates a vibrational (e.g., a pressure) wave in a fluid as it is being introduced into the formation. The step of applying the pressure pulse may be performed at the surface or in the well bore. The pressure pulse may be applied to the consolidating agent or to a separate fluid introduced into the well bore. In some embodiments, the frequency of the pressure pulses applied to the fluid may be in the range of from about 0.001 Hz to about 1 Hz. In some embodiments, the pressure pulse applied to the fluid may generate a pressure pulse in the portion of the subterranean formation in the range of from about 10 psi to about 3,000 psi In addition to generating vibrational waves that act to displace fines, the pressure pulse also affects the dilatancy of the pores within the formation, among other things, to provide additional energy that may help overcome the effects of surface tension and capillary pressure within the formation. As the vibrational wave passes through the formation and is reflected back, it induces dilation in the porosity of the formation. By overcoming such effects, the fluid may be able to penetrate more deeply and uniformly into the formation. The pressure pulse should be sufficient to effect some degree of pore dilation within the formation, but should be less than the fracture pressure of the formation. Generally, the use of high frequency, low amplitude pressure pulses will focus energy primarily in the near well bore region, while low frequency, high amplitude pressure pulses may be used to achieve deeper penetration.

In some embodiments, the pressure pulse may be generated by flowing the fluid through a pulsonic device, such as a fluidic oscillator. For example, the fluidic oscillator may be conveyed into the well bore on tubing. Once the fluidic oscillator has been placed at the desired location in the well bore, the fluid (e.g., the consolidation fluid) may be flowed through the fluidic oscillator to generate the desired pressure pulsing in the fluid. Examples of suitable fluidic oscillators are provided in U.S. Pat. Nos. 5,135,051; 5,165,438; and 5,893,383, the entire disclosures of which are incorporated herein by reference and in U.S. Patent Publication No. PG 2004/0256099, the entire disclosure of which is incorporated herein by reference.

III. Example Consolidating Agents

Suitable consolidating agents may comprise non-aqueous tackifying agents, aqueous tackifying agents, resins, gelable compositions, and combinations thereof. As used in the present invention, the term "tacky," in all of its forms, generally refers to a substance having a nature such that it is (or may be activated to become) somewhat sticky to the touch. In some embodiments, the consolidation agent may have a viscosity at surface temperatures in the range of from about 1 centipoise ("cP") to about 100 cP. In some embodiments, the consolidation agent may have a viscosity in the range of from about 1 cP to 50 cP. In some embodiments, the consolidation agent may have a viscosity in the range of from about 1 cP about 10 cP. In some embodiments, the consolidation agent may have a viscosity in the range of from about 1 cP about 5 cP. For the purposes of this disclosure, viscosities are measured at room temperature using a Brookfield DV II+ Viscometer with a #1 spindle at 100 rpm. The viscosity of the consolidating agent should be sufficient to have the desired penetration into the subterranean formation and coating onto the displaced fines based on a number of factors, including the pumpability of the formation and the desired depth of penetration.

A. Non-Aqueous Tackifying Agents

In some embodiments, the consolidation agents may comprise a non-aqueous tackifying agent. Non-aqueous tackifying agents suitable for use in the consolidating agents of the present invention comprise any compound that, when in liquid form or in a solvent solution, will form a non-hardening coating upon a particulate. A particularly preferred group of non-aqueous tackifying agents comprise polyamides that are liquids or in solution at the temperature of the subterranean formation such that they are, by themselves, non-hardening when introduced into the subterranean formation. A particularly preferred product is a condensation reaction product comprised of commercially available polyacids and a polyamine. Such commercial products include compounds such as mixtures of $C_{36}$ dibasic acids containing some trimer and higher oligomers and also small amounts of monomer acids that are reacted with polyamines. Other polyacids include trimer acids, synthetic acids produced from fatty acids, maleic anhydride, acrylic acid, and the like. Such acid compounds are commercially available from companies such as Witco Corporation, Union Camp, Chemtall, and Emery Industries. The reaction products are available from, for example, Champion Technologies, Inc. and Witco Corporation. Additional compounds which may be used as tackifying compounds include liquids and solutions of, for example, polyesters, polycarbonates and polycarbamates, natural resins such as shellac and the like. Combinations of suitable tackifying agents also may be suitable. Other suitable tackifying agents are described in U.S. Pat. Nos. 5,853,048 and 5,833,000, the disclosures of which are incorporated herein by reference.

Non-aqueous tackifying agents suitable for use in the present invention may be either used such that they form non-hardening coating or they may be combined with a multifunctional material capable of reacting with the tackifying compound to form a hardened coating. A "hardened coating" as used herein means that the reaction of the tackifying compound with the multifunctional material will result in a substantially non-flowable reaction product that exhibits a higher compressive strength in a consolidated agglomerate than the tackifying compound alone with the particulates. In this instance, the tackifying agent may function similarly to a hardenable resin. Multifunctional materials suitable for use in the present invention include, but are not limited to, aldehydes such as formaldehyde, dialdehydes such as glutaraldehyde, hemiacetals or aldehyde releasing compounds, diacid halides, dihalides such as dichlorides and dibromides, polyacid anhydrides such as citric acid, epoxides, furfuraldehyde, glutaraldehyde or aldehyde condensates and the like, and combinations thereof. In some embodiments of the present invention, the multifunctional material may be mixed with the tackifying compound in an amount of from about 0.01 percent to about 50 percent by weight of the tackifying compound to effect formation of the reaction product. In some preferable embodiments, the compound is present in an amount of from about 0.5 percent to about 1 percent by weight of the tackifying compound. Suitable multifunctional materials are described in U.S. Pat. No. 5,839,510, the disclosure of which is incorporated herein by reference.

In some embodiments, the consolidating agent may comprise a non-aqueous tackifying agent and a solvent. Solvents suitable for use with the non-aqueous tackifying agents of the present invention include any solvent that is compatible with the non-aqueous tackifying agent and achieves the desired viscosity effect. The solvents that can be used in the present invention preferably include those having high flash points (most preferably above about 125° F.). Examples of solvents suitable for use in the present invention include, but are not limited to, butylglycidyl ether, dipropylene glycol methyl ether, butyl bottom alcohol, dipropylene glycol dimethyl ether, diethyleneglycol methyl ether, ethyleneglycol butyl ether, methanol, butyl alcohol, isopropyl alcohol, diethyleneglycol butyl ether, propylene carbonate, d'limonene, 2-butoxy ethanol, butyl acetate, furfuryl acetate, butyl lactate, dimethyl sulfoxide, dimethyl formamide, fatty acid methyl esters, and combinations thereof. It is within the ability of one skilled in the art, with the benefit of this disclosure, to determine whether a solvent is needed to achieve a viscosity suitable to the subterranean conditions and, if so, how much.

B. Aqueous Tackifying Agents

In some embodiment, the consolidation agent may comprise an aqueous tackifying agent. As used herein, the term "aqueous tackifying agent" refers to a tackifying agent that is soluble in water. Where an aqueous tackifying agent is used, the consolidation agent generally further comprises an aqueous liquid.

Suitable aqueous tackifying agents of the present invention generally comprise charged polymers that, when in an aqueous solvent or solution, will form a non-hardening coating (by itself or with an activator) and, when placed on a particulate, will increase the continuous critical resuspension velocity of the particulate when contacted by a stream of water. The aqueous tackifying agent enhances the grain-to-grain contact between the individual particulates within the formation (e.g., proppant particulates, gravel particulates, formation particulates, or other particulates), and may help bring about the consolidation of the particulates into a cohesive, flexible, and permeable mass. Some suitable aqueous tackifying agents are described below, but additional detail on suitable materials can be found in U.S. patent application Ser. Nos. 10/864,061 and 10/864,618, the disclosures of which are incorporated herein by reference.

Examples of aqueous tackifying agents suitable for use in the present invention include, but are not limited to, acrylic acid polymers, acrylic acid ester polymers, acrylic acid derivative polymers, acrylic acid homopolymers, acrylic acid ester homopolymers (such as poly(methyl acrylate), poly (butyl acrylate), and poly(2-ethylhexyl acrylate)), acrylic acid ester co-polymers, methacrylic acid derivative polymers, methacrylic acid homopolymers, methacrylic acid ester homopolymers (such as poly(methyl methacrylate), poly(butyl methacrylate), and poly(2-ethylhexyl methacryate)), acrylamido-methyl-propane sulfonate polymers, acrylamido-methyl-propane sulfonate derivative polymers, acrylamido-methyl-propane sulfonate co-polymers, and acrylic acid/acrylamido-methyl-propane sulfonate co-polymers and combinations thereof. In particular embodiments, the aqueous tackifying agent comprises a polyacrylate ester available from Halliburton Energy Services, Inc., of Duncan, Okla. Additional information on suitable materials may be found in U.S. patent application Ser. Nos. 10/864,061 and 10/864,618, the disclosures of which are incorporated herein by reference. In some embodiments, the aqueous tackifying agent is included in the consolidating agent in an amount of from about 0.1% to about 40% by weight of the consolidating agent. In some embodiments the aqueous tackifying agent is included in the consolidating agent in an amount of from about 2% to about 30% by weight of the consolidating agent.

In some embodiments, the aqueous tackifying agent may be substantially tacky until activated (e.g., destabilized, coalesced, and/or reacted) to transform the agent into a sticky, tackifying compound at a desired term. In certain embodiments, the consolidating agents of the present invention further may comprise an activator to activate (i.e., tackify) the aqueous tackifying agent. Suitable activators include organic acids, anhydrides of organic acids that are capable of hydrolyzing in water to create organic acids, inorganic acids, inorganic salt solutions (e.g., brines), charged surfactants, charged polymers, and combinations thereof. However, any substance that is capable of making the aqueous tackifying agent insoluble in an aqueous solution may be used as an activator in accordance with the teachings of the present invention. The choice of an activator may vary, depending on, inter alia, the choice of aqueous tackifying agent. In certain embodiments, the concentration of salts present in the formation water itself may be sufficient to activate the aqueous tackifying agent. In such an embodiment it may not be necessary include an activator in the consolidating agent.

Examples of suitable organic acids that may be used as an activator include acetic acid, formic acid, and the like, and combinations thereof. In some embodiments, the activator may comprise a mixture of acetic and acetic anhydrides. Where an organic acid is used, in certain embodiments, the activation process may be analogous to coagulation. For example, many natural rubber latexes may be coagulated with acetic or formic acid during the manufacturing process.

Suitable inorganic salts that may be included in the inorganic salts solutions that may be used as an activator may comprise sodium chloride, potassium chloride, calcium chloride, or mixtures thereof.

Generally, where used, the activator may be present in an amount sufficient to provide the desired activation of the aqueous tackifying agent. In some embodiments, the activator may be present in the consolidating agents of the present invention in an amount in the range of from about 1% to about 40% by weight of the consolidating agent. However, in some embodiments, for example where an inorganic salt solution is used, the activator may be present in greater amounts. The amount of activator present in the aqueous tackifying agent may depend on, inter alia, the amount of aqueous tackifying agent present and/or the desired rate of reaction. Additional information on suitable materials may be found in U.S. patent application Ser. Nos. 10/864,061 and 10/864,618, the disclosures of which are incorporated herein by reference.

Generally, where an aqueous tackifying agent is used, the consolidating agent further comprises an aqueous liquid. The aqueous liquid present in the consolidating agent may be freshwater, saltwater, seawater, or brine, provided the salinity of the water source does not undesirably activate the aqueous tackifying agents used in the present invention. In some embodiments, the aqueous liquid may be present in an amount in the range of from about 0.1% to about 98% by weight of the consolidating agent.

In some embodiments, the consolidating agent further may comprise a surfactant. Where used, the surfactant may facilitate the coating of an aqueous tackifying agent onto particulates (e.g., fines), such as those in a subterranean formation being treated. Typically, the aqueous tackifying agents of the present invention preferentially attach to particulates having an opposite charge. For instance, an aqueous tackifying agent having a negative charge should preferentially attach to surfaces having a positive to neutral zeta potential and/or a hydrophobic surface. Similarly, positively-charged aqueous tackifying agent should preferentially attach to negative to neutral zeta potential and/or a hydrophilic surfaces. Therefore, in some embodiments of the present invention, a cationic surfactant may be included in the consolidating agent to facilitate the application of the negatively-charged aqueous tackifying agent to a particulate having a negative zeta potential. As will be understood by one skilled in the art, amphoteric and zwitterionic surfactants and combinations thereof may also be used so long as the conditions they are exposed to during use are such that they display the desired charge. For example, in some embodiments, mixtures of cationic and amphoteric surfactants may be used. Any surfactant compatible with the aqueous tackifying agent may be used in the present invention. Such surfactants include, but are not limited to, ethoxylated nonyl phenol phosphate esters, mixtures of one or more cationic surfactants, one or more non-ionic surfactants, and an alkyl phosphonate surfactant. Suitable mixtures of one or more cationic and nonionic surfactants are described in U.S. Pat. No. 6,311,773, the disclosure of which is incorporated herein by reference. In some embodiments, a $C_{12}$-$C_{22}$ alkyl phosphonate surfactant may be used. In some embodiments, the surfactant may be present in the consolidating agent in an amount in the range of from about 0.1% to about 15% by weight of the consolidating agent. In some embodiments, the surfactant may be present in an amount of from about 1% to about 5% by weight of the consolidating agent.

In some embodiments, where an aqueous tackifying agent is used, the consolidating agent further may comprise a solvent. Such a solvent may be used, among other things, to reduce the viscosity of the consolidating agent where desired. In embodiments using a solvent, it is within the ability of one skilled in the art, with the benefit of this disclosure, to determine how much solvent is needed to achieve a viscosity suitable to the subterranean conditions. Any solvent that is compatible with the aqueous tackifying agent and achieves the desired viscosity effects is suitable for use in the present invention. The solvents that can be used in the present invention preferably include those having high flash points (most preferably above about 125° F.). Examples of some solvents suitable for use in the present invention include, but are not limited to, water, butylglycidyl ether, dipropylene glycol methyl ether, butyl bottom alcohol, dipropylene glycol dimethyl ether, diethyleneglycol methyl ether, ethyleneglycol butyl ether, diethyleneglycol butyl ether, propylene carbonate, butyl lactate, dimethyl sulfoxide, dimethyl formamide, fatty acid methyl esters, and combinations thereof.

C. Curable Resins

In some embodiment, the consolidating agent may comprise a resin. "Resin," as used herein, refers to any of numerous physically similar polymerized synthetics or chemically modified natural resins including thermoplastic materials and thermosetting materials.

Suitable resins include both curable and non-curable resins. Curable resins suitable for use in the consolidating agents of the present invention include any resin capable of forming a hardened, consolidated mass. Whether a particular resin is curable or non-curable depends on a number of factors, including molecular weight, temperature, resin chemistry, and a variety of other factors known to those of ordinary skill in the art.

Suitable resins include, but are not limited to, two component epoxy based resins, novolak resins, polyepoxide resins, phenol-aldehyde resins, urea-aldehyde resins, urethane resins, phenolic resins, furan resins, furan/furfuryl alcohol resins, phenolic/latex resins, phenol formaldehyde resins, polyester resins and hybrids and copolymers thereof, polyurethane resins and hybrids and copolymers thereof, acrylate resins, and mixtures thereof. Some suitable resins, such as epoxy resins, may be cured with an internal catalyst or activator so that when pumped down hole, they may be cured using only time and temperature. Other suitable resins, such as furan resins generally require a time-delayed catalyst or an external catalyst to help activate the polymerization of the resins if the cure temperature is low (i.e., less than 250° F.), but will cure under the effect of time and temperature if the formation temperature is above about 250° F., preferably above about 300° F. It is within the ability of one skilled in the art, with the benefit of this disclosure, to select a suitable resin for use in embodiments of the present invention and to determine whether a catalyst is required to trigger curing.

In some embodiments, the consolidating agent comprises a resin and a solvent. Any solvent that is compatible with the resin and achieves the desired viscosity effect is suitable for use in the present invention. Preferred solvents include those listed above in connection with the nonaqueous tackifying compounds. It is within the ability of one skilled in the art, with the benefit of this disclosure, to determine whether and how much solvent is needed to achieve a suitable viscosity.

D. Gelable Compositions

In some embodiments, the consolidating agents comprise a gelable composition. Gelable compositions suitable for use in the present invention include those compositions that cure to form a semi-solid, immovable, gel-like substance. The gelable composition may be any gelable liquid composition capable of converting into a gelled substance capable of substantially plugging the permeability of the formation while allowing the formation to remain flexible. As referred to herein, the term "flexible" refers to a state wherein the treated portion of the formation is relatively malleable and elastic and able to withstand substantial pressure cycling without substantial breakdown of the formation. Thus, the resultant gelled substance stabilizes the treated portion of the formation while allowing the formation to absorb the stresses created during pressure cycling. As a result, the gelled substance may aid in preventing breakdown of the formation both by stabilizing and by adding flexibility to the treated region. Examples of suitable gelable liquid compositions include, but are not limited to, (1) gelable resin compositions, (2) gelable aqueous silicate compositions, (3) crosslinkable aqueous polymer compositions, and (4) polymerizable organic monomer compositions.

1. Gelable Resin Compositions

Certain embodiments of the gelable liquid compositions of the present invention comprise gelable resin compositions that cure to form flexible gels. Unlike the curable resins described above, which cure into hardened masses, the gelable resin compositions cure into flexible, gelled substances that form resilient gelled substances. Gelable resin compositions allow the treated portion of the formation to remain flexible and to resist breakdown. Generally, the gelable resin compositions useful in accordance with this invention comprise a curable resin, a diluent, and a resin curing agent. When certain resin curing agents, such as polyamides, are used in the curable resin compositions, the compositions form the semi-solid, immovable, gelled substances described above. Where the resin curing agent used may cause the organic resin compositions to form hard, brittle material rather than a desired gelled substance, the curable resin compositions may further comprise one or more "flexibilizer additives" (described in more detail below) to provide flexibility to the cured compositions.

Examples of gelable resins that can be used in the present invention include, but are not limited to, organic resins such as polyepoxide resins (e.g., Bisphenol a-epichlorihydrin resins), polyester resins, urea-aldehyde resins, furan resins, urethane resins, and mixtures thereof. Of these, polyepoxide resins are preferred.

Any solvent that is compatible with the gelable resin and achieves the desired viscosity effect is suitable for use in the present invention. Examples of solvents that may be used in the gelable resin compositions of the present invention include, but are not limited to, phenols; formaldehydes; furfuryl alcohols; furfurals; alcohols; ethers such as butyl glycidyl ether and cresyl glycidyl etherphenyl glycidyl ether; and mixtures thereof. In some embodiments of the present invention, the solvent comprises butyl lactate. Among other things, the solvent acts to provide flexibility to the cured composition. The solvent may be included in the gelable resin composition in an amount sufficient to provide the desired viscosity effect.

Generally, any resin curing agent that may be used to cure an organic resin is suitable for use in the present invention. When the resin curing agent chosen is an amide or a polyamide, generally no flexibilizer additive will be required because, inter alia, such curing agents cause the gelable resin composition to convert into a semi-solid, immovable, gelled substance. Other suitable resin curing agents (such as an amine, a polyamine, methylene dianiline, and other curing agents known in the art) will tend to cure into a hard, brittle material and will thus benefit from the addition of a flexibilizer additive. Generally, the resin curing agent used is included in the gelable resin composition, whether a flexibilizer additive is included or not, in an amount in the range of from about 5% to about 75% by weight of the curable resin. In some embodiments of the present invention, the resin curing agent used is included in the gelable resin composition in an amount in the range of from about 20% to about 75% by weight of the curable resin.

As noted above, flexibilizer additives may be used, inter alia, to provide flexibility to the gelled substances formed from the curable resin compositions. Flexibilizer additives may be used where the resin curing agent chosen would cause the gelable resin composition to cure into a hard and brittle material—rather than a desired gelled substance. For example, flexibilizer additives may be used where the resin curing agent chosen is not an amide or polyamide. Examples of suitable flexibilizer additives include, but are not limited to, an organic ester, an oxygenated organic solvent, an aromatic solvent, and combinations thereof. Of these, ethers, such as dibutyl phthalate, are preferred. Where used, the flexibilizer additive may be included in the gelable resin composition in an amount in the range of from about 5% to about 80% by weight of the gelable resin. In some embodiments of the present invention, the flexibilizer additive may be included in the curable resin composition in an amount in the range of from about 20% to about 45% by weight of the curable resin.

2. Gelable Aqueous Silicate Compositions

In some embodiments, the consolidating agents of the present invention may comprise a gelable aqueous silicate composition. Generally, the gelable aqueous silicate compositions that are useful in accordance with the present invention generally comprise an aqueous alkali metal silicate solution and a temperature activated catalyst for gelling the aqueous alkali metal silicate solution.

The aqueous alkali metal silicate solution component of the gelable aqueous silicate compositions generally comprise an aqueous liquid and an alkali metal silicate. The aqueous liquid component of the aqueous alkali metal silicate solution generally may be fresh water, salt water (e.g., water containing one or more salts dissolved therein), brine (e.g., saturated salt water), seawater, or any other aqueous liquid that does not adversely react with the other components used in accordance with this invention or with the subterranean formation. Examples of suitable alkali metal silicates include, but are not limited to, one or more of sodium silicate, potassium silicate, lithium silicate, rubidium silicate, or cesium silicate. Of these, sodium silicate is preferred. While sodium silicate exists in many forms, the sodium silicate used in the aqueous alkali metal silicate solution preferably has a $Na_2O$-to-$SiO_2$ weight ratio in the range of from about 1:2 to about 1:4. Most preferably, the sodium silicate used has a $Na_2O$-to-$SiO_2$ weight ratio in the range of about 1:3.2. Generally, the alkali metal silicate is present in the aqueous alkali metal silicate solution component in an amount in the range of from about 0.1% to about 10% by weight of the aqueous alkali metal silicate solution component.

The temperature-activated catalyst component of the gelable aqueous silicate compositions is used, inter alia, to convert the gelable aqueous silicate compositions into the desired semi-solid, immovable, gelled substance described above. Selection of a temperature-activated catalyst is related, at least in part, to the temperature of the subterranean formation to which the gelable aqueous silicate composition will be introduced. The temperature-activated catalysts that can be used in the gelable aqueous silicate compositions of the present invention include, but are not limited to, ammonium sulfate (which is most suitable in the range of from about 60° F. to about 240° F.); sodium acid pyrophosphate (which is most suitable in the range of from about 60° F. to about 240° F.); citric acid (which is most suitable in the range of from about 60° F. to about 120° F.); and ethyl acetate (which is most suitable in the range of from about 60° F. to about 120° F.). Generally, the temperature-activated catalyst is present in the gelable aqueous silicate composition in the range of from about 0.1% to about 5% by weight of the gelable aqueous silicate composition.

3. Crosslinkable Aqueous Polymer Compositions

In other embodiments, the consolidating agent of the present invention comprises a crosslinkable aqueous polymer compositions. Generally, suitable crosslinkable aqueous polymer compositions comprise an aqueous solvent, a crosslinkable polymer, and a crosslinking agent. Such compositions are similar to those used to form gelled treatment fluids, such as fracturing fluids, but, according to the methods of the present invention, they are not exposed to breakers or de-linkers and so they retain their viscous nature over time.

The aqueous solvent may be any aqueous solvent in which the crosslinkable composition and the crosslinking agent may be dissolved, mixed, suspended, or dispersed therein to facilitate gel formation. For example, the aqueous solvent used may be fresh water, salt water, brine, seawater, or any other aqueous liquid that does not adversely react with the other components used in accordance with this invention or with the subterranean formation.

Examples of crosslinkable polymers that can be used in the crosslinkable aqueous polymer compositions include, but are not limited to, carboxylate-containing polymers and acrylamide-containing polymers. Preferred acrylamide-containing polymers include polyacrylamide, partially hydrolyzed polyacrylamide, copolymers of acrylamide and acrylate, and carboxylate-containing terpolymers and tetrapolymers of acrylate. Additional examples of suitable crosslinkable polymers include hydratable polymers comprising polysaccharides and derivatives thereof and that contain one or more of the monosaccharide units galactose, mannose, glucoside, glucose, xylose, arabinose, fructose, glucuronic acid, or pyranosyl sulfate. Suitable natural hydratable polymers include, but are not limited to, guar gum, locust bean gum, tara, konjak, tamarind, starch, cellulose, karaya, xanthan, tragacanth, and carrageenan, and derivatives of all of the above. Suitable hydratable synthetic polymers and copolymers that may be used in the crosslinkable aqueous polymer compositions include, but are not limited to, polyacrylates, polymethacrylates, polyacrylamides, maleic anhydride, methylvinyl ether polymers, polyvinyl alcohols, and polyvinylpyrrolidone. The crosslinkable polymer used should be included in the crosslinkable aqueous polymer composition in an amount sufficient to form the desired gelled substance in the subterranean formation. In some embodiments of the present invention, the crosslinkable polymer is included in the crosslinkable aqueous polymer composition in an amount in the range of from about 1% to about 30% by weight of the aqueous solvent. In another embodiment of the present invention, the crosslinkable polymer is included in the crosslinkable aqueous polymer composition in an amount in the range of from about 1% to about 20% by weight of the aqueous solvent.

The crosslinkable aqueous polymer compositions of the present invention further comprise a crosslinking agent for crosslinking the crosslinkable polymers to form the desired gelled substance. In some embodiments, the crosslinking agent is a molecule or complex containing a reactive transition metal cation. A most preferred crosslinking agent comprises trivalent chromium cations complexed or bonded to anions, atomic oxygen, or water. Examples of suitable crosslinking agents include, but are not limited to, compounds or complexes containing chromic acetate and/or chromic chloride. Other suitable transition metal cations include chromium VI within a redox system, aluminum III, iron II, iron III, and zirconium IV.

The crosslinking agent should be present in the crosslinkable aqueous polymer compositions of the present invention in an amount sufficient to provide, inter alia, the desired degree of crosslinking. In some embodiments of the present invention, the crosslinking agent is present in the crosslinkable aqueous polymer compositions of the present invention in an amount in the range of from about 0.01% to about 5% by weight of the crosslinkable aqueous polymer composition. The exact type and amount of crosslinking agent or agents used depends upon the specific crosslinkable polymer to be crosslinked, formation temperature conditions, and other factors known to those individuals skilled in the art.

Optionally, the crosslinkable aqueous polymer compositions may further comprise a crosslinking delaying agent, such as a polysaccharide crosslinking delaying agent derived from guar, guar derivatives, or cellulose derivatives. The crosslinking delaying agent may be included in the crosslinkable aqueous polymer compositions, inter alia, to delay crosslinking of the crosslinkable aqueous polymer compositions until desired. One of ordinary skill in the art, with the benefit of this disclosure, will know the appropriate amount of the crosslinking delaying agent to include in the crosslinkable aqueous polymer compositions for a desired application.

4. Polymerization Organic Monomer Compositions

In other embodiments, the gelled liquid compositions of the present invention comprise polymerizable organic monomer compositions. Generally, suitable polymerizable organic monomer compositions comprise an aqueous-base fluid, a water-soluble polymerizable organic monomer, an oxygen scavenger, and a primary initiator.

The aqueous-based fluid component of the polymerizable organic monomer composition generally may be fresh water, salt water, brine, seawater, or any other aqueous liquid that does not adversely react with the other components used in accordance with this invention or with the subterranean formation.

A variety of monomers are suitable for use as the water-soluble polymerizable organic monomers in the present invention. Examples of suitable monomers include, but are not limited to, acrylic acid, methacrylic acid, acrylamide, methacrylamide, 2-methacrylamido-2-methylpropane sulfonic acid, 2-dimethylacrylamide, vinyl sulfonic acid, N,N-dimethylaminoethylmethacrylate, 2-triethylammoniumethylmethacrylate chloride, N,N-dimethylaminopropylmethacryl-amide, methacrylamidepropyltriethylammonium chloride, N-vinyl pyrrolidone, vinyl-phosphonic acid, and methacryloyloxyethyl trimethylammonium sulfate, and mixtures thereof. Preferably, the water-soluble polymerizable organic monomer should be self-crosslinking. Examples of suitable monomers which are self crosslinking include, but are not limited to, hydroxyethylacrylate, hydroxymethylacrylate, hydroxyethylmethacrylate, N-hydroxymethylacrylamide, N-hydroxymethyl-methacrylamide, polyethylene glycol acrylate, polyethylene glycol methacrylate, polypropylene glycol acrylate, polypropylene glycol methacrylate, and mixtures thereof. Of these, hydroxyethylacrylate is preferred. An example of a particularly preferable monomer is hydroxyethylcellulose-vinyl phosphoric acid.

The water-soluble polymerizable organic monomer (or monomers where a mixture thereof is used) should be included in the polymerizable organic monomer composition in an amount sufficient to form the desired gelled substance after placement of the polymerizable organic monomer composition into the subterranean formation. In some embodiments of the present invention, the water-soluble polymerizable organic monomer is included in the polymerizable organic monomer composition in an amount in the range of from about 1% to about 30% by weight of the aqueous-base fluid. In another embodiment of the present invention, the water-soluble polymerizable organic monomer is included in the polymerizable organic monomer composition in an amount in the range of from about 1% to about 20% by weight of the aqueous-base fluid.

The presence of oxygen in the polymerizable organic monomer composition may inhibit the polymerization process of the water-soluble polymerizable organic monomer or monomers. Therefore, an oxygen scavenger, such as stannous chloride, may be included in the polymerizable monomer composition. In order to improve the solubility of stannous chloride so that it may be readily combined with the polymerizable organic monomer composition on the fly, the stannous chloride may be pre-dissolved in a hydrochloric acid solution. For example, the stannous chloride may be dissolved in a 0.1% by weight aqueous hydrochloric acid solution in an amount of about 10% by weight of the resulting solution. The resulting stannous chloride-hydrochloric acid solution may be included in the polymerizable organic monomer composition in an amount in the range of from about 0.1% to about 10% by weight of the polymerizable organic monomer composition. Generally, the stannous chloride may be included in the polymerizable organic monomer composition of the present invention in an amount in the range of from about 0.005% to about 0.1% by weight of the polymerizable organic monomer composition.

The primary initiator is used, inter alia, to initiate polymerization of the water-soluble polymerizable organic monomer(s) used in the present invention. Any compound or compounds that form free radicals in aqueous solution may be used as the primary initiator. The free radicals act, inter alia, to initiate polymerization of the water-soluble polymerizable organic monomer present in the polymerizable organic monomer composition. Compounds suitable for use as the primary initiator include, but are not limited to, alkali metal persulfates; peroxides; oxidation-reduction systems employing reducing agents, such as sulfites in combination with oxidizers; and azo polymerization initiators. Preferred azo polymerization initiators include 2,2'-azobis(2-imidazole-2-hydroxyethyl) propane, 2,2'-azobis(2-aminopropane), 4,4'-azobis(4-cyanovaleric acid), and 2,2'-azobis(2-methyl-N-(2-hydroxyethyl) propionamide. Generally, the primary initiator should be present in the polymerizable organic monomer composition in an amount sufficient to initiate polymerization of the water-soluble polymerizable organic monomer(s). In certain embodiments of the present invention, the primary initiator is present in the polymerizable organic monomer composition in an amount in the range of from about 0.1% to about 5% by weight of the water-soluble polymerizable organic monomer(s). One skilled in the art will recognize that as the polymerization temperature increases, the required level of activator decreases.

Optionally, the polymerizable organic monomer compositions further may comprise a secondary initiator. A secondary initiator may be used, for example, where the immature aqueous gel is placed into a subterranean formation that is relatively cool as compared to the surface mixing, such as when placed below the mud line in offshore operations. The secondary initiator may be any suitable water-soluble compound or compounds that may react with the primary initiator to provide free radicals at a lower temperature. An example of a suitable secondary initiator is triethanolamine. In some embodiments of the present invention, the secondary initiator is present in the polymerizable organic monomer composition in an amount in the range of from about 0.1% to about 5% by weight of the water-soluble polymerizable organic monomer(s).

Also optionally, the polymerizable organic monomer compositions of the present invention further may comprise a crosslinking agent for crosslinking the polymerizable organic monomer compositions in the desired gelled substance. In some embodiments, the crosslinking agent is a molecule or complex containing a reactive transition metal cation. A most preferred crosslinking agent comprises trivalent chromium cations complexed or bonded to anions, atomic oxygen, or water. Examples of suitable crosslinking agents include, but are not limited to, compounds or complexes containing chromic acetate and/or chromic chloride. Other suitable transition metal cations include chromium VI within a redox system, aluminum III, iron II, iron III, and zirconium IV. Generally, the crosslinking agent may be present in polymerizable organic monomer compositions in an amount in the range of from 0.01% to about 5% by weight of the polymerizable organic monomer composition.

To facilitate a better understanding of the present invention, the following example of certain aspects of some embodiments are given. In no way should the following example be read to limit, or define, the scope of the invention.

EXAMPLE 1 gram of coal particulates was added to a scintillation vial. Next, 9 mL of water were added followed by 0.1 mL of a polyacrylate ester, available from Halliburton Energy Services, Inc,. Duncan, Okla. This sample was manually agitated for about 1 minute. Then, 0.5 mL of a chemical activator (acetic anhydride/acetic acid) was added using a syringe with gentle agitation of the sample. After about 1 minute, the liquid was decanted and the treated coal was washed in 10 mL of water. Next, the treated coal was transferred to a clean vial and 10 mL of water were added. Finally, the treated coal together with untreated coal particulates were sonicated for 45 minutes. The treated coal did not produce any visible fines.

Therefore, as illustrated by this example, consolidating agents may be used in conjunction with sonication (e.g., vibrational waves) to stabilize particulates.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. In particular, every range of values (of the form, "from about a to about b," or, equivalently, "from approximately a to b," or, equivalently, "from approximately a-b") disclosed herein is to be understood as referring to the power set (the set of all subsets) of the respective range of values, and set forth every range encompassed within the broader range of values. Also, the terms in the claims have their plain, ordinary meaning unless otherwise explicitly and clearly defined by the patentee.

What is claimed is:

1. A method comprising:

directing vibrational waves at a portion of a subterranean formation containing fines;

allowing the vibrational waves to displace at least a portion of the fines; and introducing a consolidating agent into the portion of the subterranean formation through a well bore that penetrates the portion of the subterranean formation.

2. The method of claim 1 wherein the fines contained in the portion of the subterranean formation impede the flow of fluid through the portion of the subterranean formation.

3. The method of claim 1 further comprising the step of:

generating the vibrational waves utilizing an acoustic stimulation tool.

4. The method of claim 1 wherein the vibrational waves are transferred to the portion of the subterranean formation through a fluid in the well bore.

5. The method of claim 4 wherein the fluid is the consolidating agent.

6. The method of claim 1 further comprising the step of:

applying a pressure pulse to a fluid that is being introduced into the portion of the subterranean formation so as to generate the vibrational wave.

7. The method of claim 6 wherein the pressure pulse is applied at a frequency in the range of from about 0.001 Hz to about 1 Hz.

8. The method of claim 6 wherein the pressure pulse applied to the fluid generates a pressure pulse in the portion of the subterranean formation in the range of from about 10 psi to about 3,000 psi.

9. The method of claim 6 wherein the pressure pulse is applied to the fluid at the surface or in the well bore.

10. The method of claim 1 further comprising the step of:

flowing a fluid through a fluidic oscillator so as to generate the vibrational waves.

11. The method of claim 1 wherein the portion of the subterranean formation comprises at least one member selected from the group consisting of a proppant pack, a gravel pack, a liner, a sand control screen, and combinations thereof.

12. The method of claim 1 wherein the step of introducing the consolidating agent into the portion of the subterranean formation occurs during or after the step of the directing vibrational waves.

13. The method of claim 1 wherein the consolidating agent comprises at least one member selected from the group consisting of a non-aqueous tackifying agent, an aqueous tackifying agent, a resin, a gelable composition, and combinations thereof.

14. The method of claim 13 wherein the consolidating agent further comprises a solvent.

15. The method of claim 1 wherein the consolidating agent comprises a solvent and an aqueous tackifying agent.

16. The method of claim 1 wherein the consolidating agent comprises a solvent and an aqueous tackifying agent selected from the group consisting of an acrylic acid polymer, an acrylic acid ester polymer, an acrylic acid derivative polymer, an acrylic acid homopolymer, an acrylic acid ester homopolymer, an acrylic acid ester co-polymers, a methacrylic acid derivative polymers, a methacrylic acid homopolymers, a methacrylic acid ester homopolymers, an acrylamido-methyl-propane sulfonate polymer, an acrylamido-methylpropane sulfonate derivative polymer, an acrylamido-methyl-propane sulfonate co-polymer, an acrylic acid/acrylamido-methyl-propane sulfonate co-polymer, and combinations thereof.

17. The method of claim 1 wherein the consolidating agent comprises a solvent and an aqueous tackifying agent comprising a polyacrylate ester.

18. The method of claim 1 wherein the consolidating agent comprises a solvent, an aqueous tackifying agent, and an activator.

19. A method of remediating a subterranean particulate pack comprising:

directing vibrational waves at the particulate pack, the particulate pack containing fines;

allowing the vibrational waves to displace at least a portion of the fines; and introducing a consolidating agent into the well bore so as to contact the particulate pack.

20. The method of claim 19 wherein the particulate pack is a gravel pack or a proppant pack.

21. The method of claim 19 further comprising the step of:

generating the vibrational waves utilizing an acoustic stimulation tool.

22. The method of claim 19 further comprising the step of:

applying a pressure pulse to a fluid that is being introduced into the portion of the subterranean formation so as to generate the vibrational wave.

23. The method of claim 22 wherein the fluid is the consolidating agent.

24. A method of remediating a subterranean formation:

generating vibrational waves in a consolidating agent by flowing the consolidating agent through a fluidic oscillator located in a well bore that penetrates the subterranean formation;

introducing the consolidating agent into a portion of the subterranean formation that contains fines; and allowing the vibrational waves in the consolidating agent to displace at least a portion of the fines so as to increase fluid flow through the portion of the subterranean formation.

* * * * *